United States Patent [19]

Andis

[11] 4,249,307

[45] Feb. 10, 1981

[54] HAIR CLIPPER

[75] Inventor: Matthew L. Andis, Racine, Wis.

[73] Assignee: Andis Company, Racine, Wis.

[21] Appl. No.: 916,511

[22] Filed: Jun. 19, 1978

[51] Int. Cl.[3] ..... B26B 19/06

[52] U.S. Cl. ..... 30/216; 30/220; 30/223

[58] Field of Search ..... 30/220, 223, 216, 224, 30/210, 225

[56] References Cited

U.S. PATENT DOCUMENTS

| | | | |
|---|---|---|---|
| 1,956,042 | 4/1934 | Oster | 30/221 |
| 2,182,597 | 12/1939 | Oster | 30/210 |
| 2,704,887 | 3/1955 | Andis | 30/210 |
| 2,790,236 | 4/1957 | Andis | 30/210 |
| 2,959,855 | 11/1960 | Andis | 30/208 |
| 3,101,535 | 8/1963 | Andis | 30/223 |
| 3,222,781 | 12/1965 | Luther et al. | 30/210 |
| 3,992,778 | 11/1976 | Urbush | 30/216 |

*Primary Examiner*—Othell M. Simpson
*Assistant Examiner*—Roscoe V. Parker
*Attorney, Agent, or Firm*—Michael, Best & Friedrich

[57] ABSTRACT

Disclosed herein is a hair clipper including a housing, a motor located in the housing and including a shaft having a drive member thereon, and a blade set connected to the housing. The blade set includes a lower blade connected to the housing, and a movable blade assembly including a thin planar movable upper blade member and a shoe member including a planar body having a groove formed in its upper surface, a notch therein, and laterally spaced wall portions on opposite sides of the notch and extending upwardly from the upper surface. The movable blade assembly also includes a yoke member secured between the upper surface of the movable blade member and the shoe member, the yoke member including first and second laterally spaced walls extending upwardly through the notch and being engaged by the drive member to cause reciprocating movement of the movable blade assembly relative to the fixed blade. The hair clipper also includes a spring member for supporting the movable blade assembly against the lower blade for linear movement and a fixed threaded stud extending from the upper surface of the fixed blade for releasably securing the spring member to the lower blade. The hair clipper also includes a blade set mounting assembly including a mounting plate fixed to the hair clipper housing and a tongue carried by the mounting plate for pivotal movement between a first position at a substantial angle to the mounting plate permitting insertion and withdrawal of the tongue and a second position whereby such insertion and withdrawal is prevented.

23 Claims, 6 Drawing Figures

HAIR CLIPPER

BACKGROUND OF THE INVENTION

The invention relates to hair clippers and to electrically operated hair clippers. More particularly, the invention relates to movable blade assemblies for hair clippers and to means for supporting the movable blade assembly of a hair clipper against the lower blade portion such that the movable blade assembly can be readily separated from the lower blade for cleaning or replacement of the movable blade. The invention also relates to means for releasably and selectively retaining a blade set in an operating position against the housing of a hair clipper and alternatively in a second position affording connection and disconnection of the blade set from the blade set supporting means.

Attention is directed to the Urbush U.S. Pat. No. 3,992,778, issued Nov. 23, 1976 to the assignee of the present invention. The Urbush patent illustrates an electrically operated hair clipper including a pivotable blade set. Attention is also directed to U.S. Pat. No. 2,704,887, issued Mar. 29, 1955; U.S. Pat. No. 2,790,236, issued Apr. 30, 1957; U.S. Pat. No. 2,959,855, issued Nov. 15, 1960; and U.S. Pat. No. 3,101,535, issued Aug. 27, 1963, each of these patents illustrating electrically operated hair clippers of varied constructions and each assigned to the assignee of the present invention.

Attention is further directed to the Oster U.S. Pat. Nos. 1,956,042, issued Apr. 24, 1934 and 2,182,597, issued Dec. 5, 1939 showing hair clippers having blade sets which are movable from an operating position to a pivoted position wherein the blade set is removable from a supporting tongue and also showing spring biasing means for releasably supporting a blade set in the operating position and in a pivoted position. A similar hair clipper having a pivotable blade set is disclosed in the Luther et al U.S. Pat. No. 3,222,781, issued Dec. 14, 1965.

SUMMARY OF THE INVENTION

The invention provides a hair clipper including a housing, a motor located in the housing and including a shaft having a drive member thereon, and a blade set connected to the housing. The blade set includes a lower blade connected to the housing, a movable blade member having a forward edge with a series of teeth extending therealong, and an upper surface extending from the forward edge, and a shoe member including a planar body having an upper surface, and a groove formed in the upper surface, a notch in the planar body, and first and second wall portions on opposite sides of the notch and extending upwardly from the upper surface and in laterally spaced parallel relation to each other. The blade set also includes a driven element secured between the upper surface of the movable blade member and the shoe member, and including first and second laterally spaced walls. Means are also provided for fixedly securing together in assembled relation the blade member, the drive member, and the shoe member with the driven member first and second walls extending upwardly through the notch, the first spaced driven element wall located adjacent one of the first and second wall portions and the second spaced driven element wall located adjacent the other of the first and second wall portions. The spaced driven element walls are engaged by the drive member to cause reciprocating movement of the movable blade assembly relative to the fixed blade.

The invention also provides a movable blade assembly for a hair clipper blade set, the movable blade assembly including a blade member having a forward edge with a series of teeth extending therealong and an upper surface extending from the forward edge, and a yoke member including first and second walls extending in laterally spaced relation to each other, the yoke member also including first and second flange portions respectively extending in laterally co-planar relation from the first and second walls. The movable blade assembly also includes a shoe member having a planar body with an upper surface, and a groove formed in the upper surface, a notch in the planar body, and first and second wall portions on opposite sides of the notch and extending upwardly from the planar body upper surface and in laterally spaced parallel relation to each other. The movable blade assembly further includes means fixedly securing together in assembled relation the blade member, the yoke member and the shoe member with the first and second yoke member flange portions secured between the shoe member planar body and the blade member upper surface, and with the first and second yoke member walls extending through the notch with the first and second shoe member wall portions in outwardly overlying engagement with the first and second yoke member walls.

The invention also provides a hair clipper lower blade including a forward edge with a series of teeth extending therealong and an upper surface extending from the forward edge, and a movable upper blade having a forward edge with a series of teeth extending therealong, an upper surface and a lower planar surface supported by the upper surface of the lower blade. The blade set also includes means for supporting the movable blade against the lower blade and for linear movement parallel to the lower edges, the supporting means including a spring member having a forward end positionable against the upper surface of the movable blade and a rearward end having therein at least one aperture, and means for releasably securing the spring member to the lower blade and including a fixed stud extending from the upper surface of the fixed blade through the aperture, and means for securing the spring member to the fixed stud.

The invention further provides a hair clipper including a housing having a recess, a blade set having a stationary blade with means thereon defining a socket, and a blade set mounting assembly. The blade set mounting assembly includes a mounting plate fixed to the housing assembly, a tongue including a shoulder, the tongue being carried by the mounting plate for pivotal movement of the tongue relative to the mounting plate between a first position extending at a substantial angle to the mounting plate permitting insertion and withdrawal of the tongue relative to the socket and a second position generally parallel to the mounting plate, and a spring secured to the mounting plate. The spring includes a first portion including means for engaging the tongue for selectively and releasably holding the tongue in the first position and a second portion for selectively gripping the means defining the socket to releasably clamp the blade set against the shoulder on the tongue when the stationary blade is assembled on the tongue and in response to movement of the tongue to the second position.

One of the principal features of the invention is the provision of the blade set mounting assembly having a spring including a spring lip at one end thereof releasably engaging the forward edge of a mounting bracket secured to the lower blade, and including another end engaging a transverse portion of the tongue for selectively and releasably holding the tongue in the first position.

Another of the principal features of the invention is the provision of the movable blade assembly of the separability of the movable blade member, the shoe member, and the yoke member and the provision of releasable means including at least one bore in one of the blade member and the shoe member and a pin extending from the other of the blade member and the shoe member and being engaged in the bore.

Another of the principal features of the invention is the provision in the blade set of a bracket secured to the upper surface of the lower blade, the bracket including a threaded bore therethrough, a screw for securing the bracket to the fixed blade and including an end extending through the bracket and forming a fixed threaded stud for supporting the movable blade assembly.

Other features and advantages of the embodiments of the invention will become known by reference to the following description, to the appended claims, and to the drawings.

Figure 1:
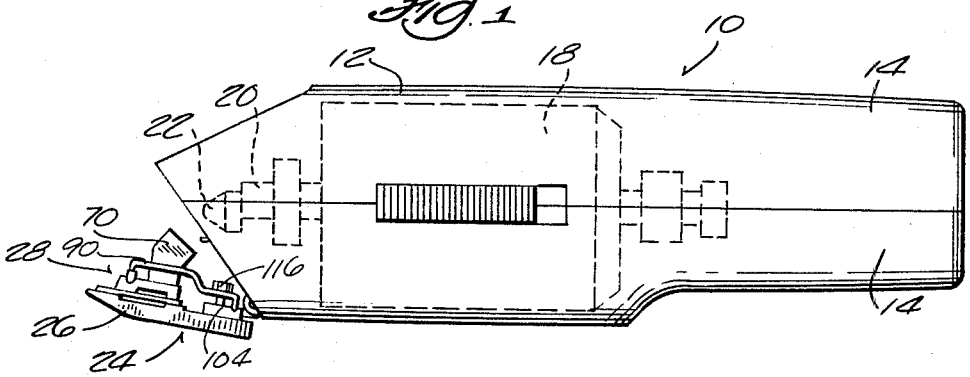
FIG. 1 is a side elevation view of a hair clipper embodying various of the features of the invention.

Before explaining a preferred embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

Shown in the drawings is an electrical hair clipper 10 which embodies various of the features of the invention and which includes a housing 12 which is constructed of electrically insulating material, such as plastic. Any suitable design can be employed and, in the illustrated construction, the housing comprises two sections or parts 14 which are connected together. Located in the housing 12 is an electric motor 18 which can be of various designs but which, preferably, is an alternating current permanent magnet motor. In the specific construction illustrated, the electric motor 18 is generally arranged in the manner disclosed in U.S. Pat. No. 3,992,778, issued Nov. 23, 1976. The electrical motor 18 includes a central rotary drive shaft 20 having an eccentric conical end portion 22 extending from its end, the eccentric end portion 22 being freely rotatable with respect to the drive shaft 20.

Figure 2:
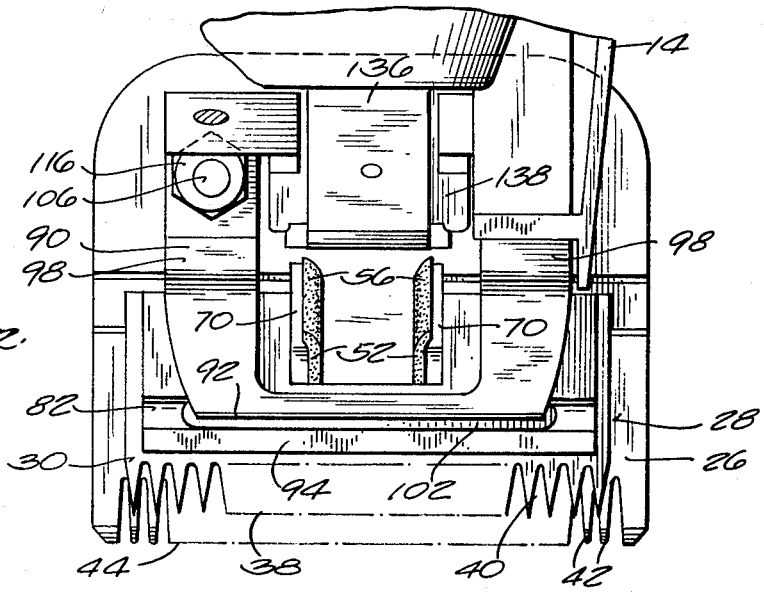
FIG. 2 is an enlarged top plan view showing the movable blade assembly drive arrangement for the blade set incorporated in the hair clipper shown in FIG. 1.
Figure 4:
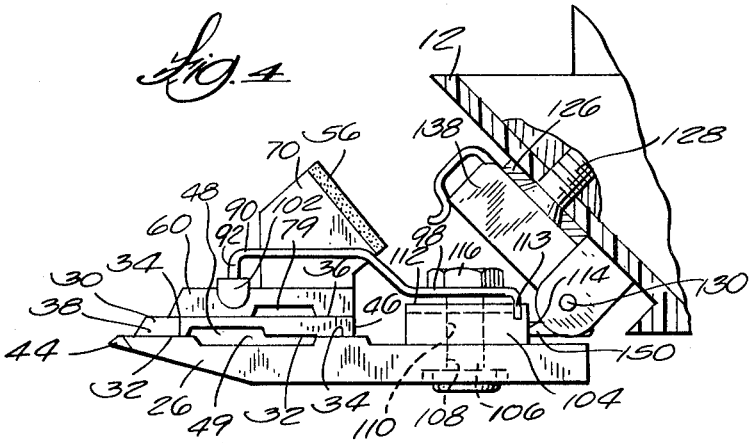
FIG. 4 is an enlarged side elevation view of the blade set and blade set mounting assembly of the hair clipper shown in FIG. 1.

Located at one end of the housing 12 is a blade set 24 which includes a fixed lower blade or shear plate 26 connected to the housing 12 and an upper movable blade, plate or comb assembly 28 reciprocable on and relative to the lower blade 26. In this last regard, the blade set 24 also includes suitable means for guiding reciprocation of the movable blade assembly 28 relative to the lower blade 26. Referring to FIG. 4, the movable blade assembly 28 includes a generally flat planar blade member or plate 30 which includes forwardly and rearwardly co-planar lower surfaces 32 which bear against the upper surfaces 34 of the lower blade 26. The planar blade member 30 also includes an upper surface 36, and a forward edge 38 with a series of teeth 40 (FIG. 2) cooperating with teeth 42 on the forward edge 44 of the lower blade 26.

The movable blade member 30 also includes a rearward edge or surface 46 which preferably extends in generally perpendicular relation to the lower and upper surfaces 32 and 36. In the illustrated construction, the lower planar surfaces 32 are separated by a shallow groove 48 parallel to the forward and rearward edges of the movable blade member 30. The upper planar surface 34 of lower blade 26 similarly includes a transverse groove 49. The grooves 48 and 49 function to provide a recess between the lower blade 26 and the movable blade 30 to facilitate mating engagement of the cutting teeth 40 and 42. In an alternative construction, either or both of the grooves 48 and 49 could be deleted.

While the movable blade member 30 can be constructed in various ways, since the movable blade member 30 is planar and relatively thin, it can be conveniently manufactured by machining suitably hardened planar sheet stock.

The movable blade assembly 28 also includes means for engaging the eccentric end portion 22 of the motor drive shaft 20 such that rotation of the motor drive shaft 20 causes reciprocation of the movable blade assembly 28 with respect of the fixed blade 26 and for electrically insulating the movable blade assembly 28 from the motor drive shaft 20.

Figure 3:
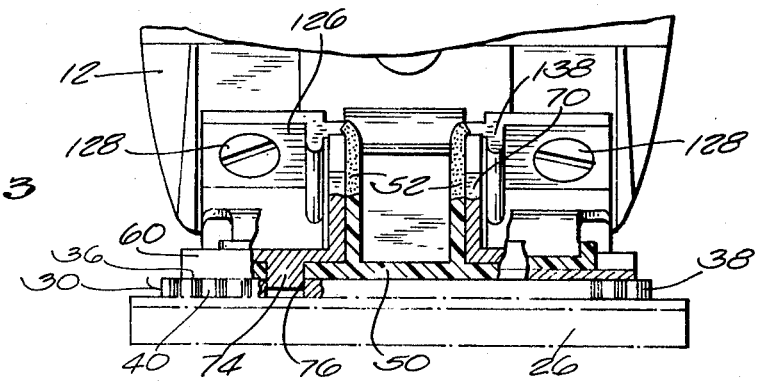
FIG. 3 is an enlarged partial end elevation view of the hair clipper blade set shown in FIG. 1 with portions broken away.
Figure 6:
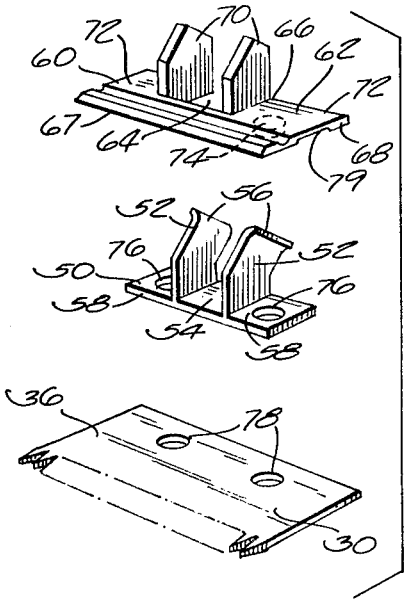
FIG. 6 is an exploded view of the movable blade assembly of the hair clipper shown in FIG. 1.

In this last regard, the movable blade assembly 28 includes a driven member or yoke member 50 (FIGS. 3 and 6) which is preferably constructed of electrically insulating material, such as plastic, and which includes a main portion which is clamped against and extends upwardly from the upper surface 36 of the movable blade member 28, and is generally of U-shape and including first and second laterally spaced arms or walls 52 which extend upwardly and which are joined at their lower end by a connecting web or wall 54. The arms or walls 52 respectively include rearwardly and upwardly extending edge portions 56 having arcuately laterally outwardly flaring terminal portions.

The yoke member 50 also includes first and second flange portions 58 which respectively extend in laterally outward relation from the first and second walls 52 and in overlying engagement with the upper surface 36 of the movable blade member 30. The flange portions 58 are also co-planar with the web 54.

The movable blade assembly 28 also includes a shoe member 60 which is preferably constructed of metal, for example, by die casting, and which includes a planar portion 62 overlying the movable blade member 30. Located centrally of the planar shoe portion 62 is a notch 64 therethrough which extends forwardly from the rearward edge 66 of the shoe member toward the forward edge 67. The notch 64 includes two laterally or transversely spaced apart edges extending in generally perpendicular relation to the forward and rearward edges 67 and 66 of the shoe member 60. First and second laterally spaced parallel wall portions 70 extend upwardly from the laterally spaced edges of the notch 64 and are located in laterally outwardly overlying relationship to the yoke walls 52 to provide structural support for the yoke walls 52. Preferably the wall portions 70 of the shoe member 60 are coextensive with the walls 52 of the yoke member above the flange portion 58 of the yoke member.

The shoe member 60 further includes flange portions 72 which respectively extend laterally outwardly and in co-planar relationship from the edges of the walls 70 and in overlying engagement with the flange portions 58 of the yoke member 50.

Means are further provided for fixedly securing the planar blade member 30, the yoke member 50, and the shoe member 60 in adjacent fixed relationship. While various arrangements can be employed, in the construction illustrated in FIGS. 3 and 6, such means comprise a pair of pins 74 which are integral with and extend downwardly from the flange portions 72 of the shoe member 60, the pins 74 being received through apertures 76 in the flanges 58 of the yoke member 50 and being engaged in an interference fit bores 78 in the upper surface of the movable blade member 30.

Means are further provided for permitting separation of the shoe member 60 and the movable blade member 30 to facilitate replacement of the movable blade member 30. While various arrangements can be provided, in the illustrated construction, the shoe member 60 includes a recess 79 in its bottom surface to permit insertion of a tool between the shoe member 60 and the flat planar blade member 30 such that the shoe member 60 and the blade member 30 can be pried apart. Since the movable blade member 30 is not riveted or otherwise permanently fixed to the shoe member 60 and can be conveniently separated therefrom, the illustrated construction provides for convenient cleaning, sharpening, or replacement of the blade member 30.

Means are further provided for engaging the yoke arms 52 of the yoke member 50 and for causing transverse reciprocating movement of the movable blade assembly 28 to cause relative movement of the teeth 40 and 42. In the illustrated construction, the eccentric end portion 22 attached to the end of the motor drive shaft 20 extends between the yoke arms 52 for engagement therebetween. Rotation of the drive shaft 20 and consequent eccentric movement of the eccentric end portion 22 will thus cause reciprocating movement of the movable blade assembly 28. The eccentric end portion 22 is provided with a conical end such that the eccentric end portion is guided between the yoke arms 52 when the blade set 24 is attached to the housing 12.

Means are further provided for biasing the movable blade assembly 28 against the upper surface 34 of the lower blade 26 and for supporting the movable blade assembly 28 for reciprocating movement in a path generally parallel to the forward edge of the lower blade 26. While various arrangements can be employed, in the illustrated construction such means includes a resilient spring member 90 having a forward linear edge 92 positioned in a groove 82 in the upper surface 81 of the shoe member 60 of the movable blade assembly 28, the groove 82 being adjacent and parallel to the forward edge of the shoe member 60. The spring member 90 is comprised of thin, generally planar spring metal and includes a planar forward portion 94 extending generally parallel to the groove in the shoe member 60, the planar forward portion 94 including a downwardly bent edge forming the forward linear edge 92. The spring member 90 is positioned in the groove 82 and is intended to exert a downward force on the movable blade assembly 28 and to guide the movable blade assembly 28 for reciprocable movement. To facilitate reciprocal sliding movement of the shoe 60 with respect to the spring member 90, in the preferred construction the forward linear edge 92 of the spring member 90 is provided with a plastic coating 102 having a low coefficient of friction.

Means are provided for supporting the spring member 90 such that the spring 90 is under tension and exerts a downward force on the movable blade assembly 28, and for permitting removal of the movable blade assembly 28 so as to provide for accurate realignment of the blade assembly 28 when it is replaced. While various arrangements can be employed, in the illustrated construction a bracket member 104 is secured to a rearward portion of the upper surface 34 of the lower blade 26 by a pair of screws 106 extending through bores 108 and through threaded bores 110 in the bracket member. In a preferred construction the bracket member 104 is construted from a hard wear resistant sintered material. The screws 106 include threaded ends projecting upwardly from the upper surface 112 of the bracket member 104 to form fixed threaded studs for supporting the spring member 90. The rearward ends of each of the fingers 98 of the spring member 90 include apertures having a diameter only slightly larger than the screws 106, the apertures being intended to receive the upwardly extending threaded studs. The rearward ends of fingers 98 of the spring member 90 also include downwardly bent flanges 113 which are received within grooves 114 in the upper surface 112 of the bracket 104. Nuts 116 are provided to threadably engage the threaded studs and to apply a downward force on the spring 90 to secure the rearward end of the spring 90 against the upper surface 112 of the bracket member 104 and to cause the forward edge of the spring member 90 to apply a downward force on the shoe member 60. It will be appreciated by one skilled in the art that the movable blade assembly 28 is thus supported such that it can be readily removed by removing the nuts 116 and slipping the spring member 90 off of the threaded studs, and without affecting adjustment of the relative position of the movable blade assembly 28 with respect to the fixed blade member 26 when the blade assembly 28 is replaced.

The bores 108 in the lower blade 26 may be larger than the diameter of the screws 106 to permit adjustment of the position of the bracket member 104 relative to the lower blade 26 to thereby facilitate adjustment of the position of the alignment spring member 90 and consequent adjustment of the relative position of the movable blade assembly 28 and the lower blade 26.

The connection of the blade set 24 and particularly the lower blade 26 to the housing 12 permits releasable attachment of the blade set 24 on the hair clipper 10. In this regard, the blade set attachment means is comprised of a socket or slot 120 formed between the bracket member 104 and the lower blade 26. The socket 120 is adapted to receive a tongue or pivot arm 124 carried on a mounting plate 126 fixed to the housing 12 by suitable means, such as a pair of screws 128. Further in this regard, the tongue or pivot arm 124 is carried by the mounting plate 126 about a hinge pin 130 for movement between a first position shown in FIG. 4 and affording insertion and withdrawal of the tongue 124 relative to the socket or slot 120 and an operating position shown in FIG. 5 in which the blade set 24 is located for engagement of the rotatable eccentric end portion 22 of the drive shaft 20 between the yoke arms 52. As indicated earlier, during movement of the tongue 124 from the first position to the operating position, the flared terminal portion 56 of the yoke arms 52 and the conical shape of the eccentric end portion 22 facilitate insertion of the eccentric end portion 22 between the yoke arms 52 to thereby permit driving engagement of the eccentrically movable end portion 22 with the yoke arms 52.

Means are provided for selectively and releasably retaining the tongue or pivot arm 124 in either the first position or in the operating position. While various arrangements are possible, in the illustrated construction, the tongue or pivot arm 124 includes, rearwardly of the hinge pin 130, an upwardly extending flange 132 which is engaged by a downwardly convex end portion 134 of a biasing spring 136 which is fixed to a raised central portion 138 of the mounting plate 126. In operation, engagement of the downwardly convex end portion 134 of the biasing spring 136 with the upwardly extending flange 132 serves to selectively and releasably retain the tongue or pivot arm 124 in the first position and in the operating position.

Means are provided for augmenting the action of the biasing spring 136. In this regard, in the illustrated construction, the housing 12 is provided with a recess 140 which receives a helical compression spring 142 which, at its outer end, bears against the top side of the downwardly convex end portion 134 of the biasing spring 136 so as to increase the force applied by the biasing spring 136 to releasably hold the tongue or pivot arm 134 in either of its two positions. Employment of the helical spring 142 also serves to partially relieve the loading on the biasing spring 136 and to thereby increase the life of the biasing spring 136.

Figure 5:
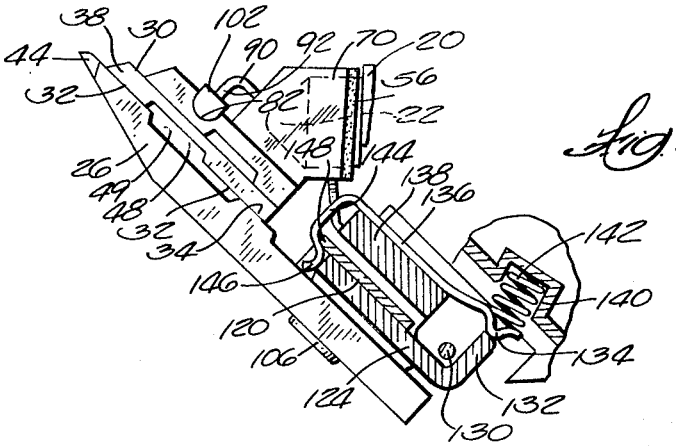
FIG. 5 is a view similar to FIG. 4 but showing the blade set in an operating position.

Means are further provided for grasping the central portion of the bracket member 104 on the lower blade 26 when the blade set is in the operating position shown in FIG. 5 to releasably prevent relative movement between the tongue or pivot arms 124 and the fixed blade 126 such that the blade set 24 is maintained in the operating position against the face of the housing 12. In the illustrated construction, this retaining means is comprised of a transverse end portion 144 at the end of the biasing spring 136 opposite the downwardly convex end portion 134. In order to releasably grip the bracket member 104 attached to the fixed blade 26, the transverse end 144 of the biasing spring 136 includes an outer lip 146 which is adapted, when the blade set 24 is received on the tongue or pivot arm 124 and is in the operating position, to grip the forward edge 148 of the stationary blade bracket 104 so as to releasably clamp the bracket member 104 of the fixed plate 26 against a shoulder 150 formed on the tongue 124 adjacent the hinge pin 130.

Thus, when the tongue 124 is in the operating position, the fixed blade 26 is firmly but releasably held stationary relative to the housing 12 as a result of the transverse end portion 144 of the biasing spring 136 releasably clamping the fixed blade 26 to the tongue 124 and as a result of the action of the downwardly convex end portion 134 of the biasing spring 136 and the helical compression spring 142 which firmly but releasably hold the tongue 124 in the operating position. In addition, when the tongue is in the first position the tongue can be easily inserted or withdrawn from the socket 120 formed between the bracket member 104 and the fixed blade 26.

Various of the features of the invention are set forth in the following claims.

What is claimed is:

1. A hair clipper comprising a housing, a motor located in said housing and including a shaft having a drive member thereon, and a blade set connected to said housing and including a lower blade connected to said housing, a movable upper blade member having a forward edge with a series of teeth extending therealong, and an upper surface extending from said forward edge, a shoe member including a planar body having an upper surface, and a groove formed in said upper surface, a notch in said planar body and first and second wall portions on opposite sides of said notch and extending upwardly from said upper surface and in laterally spaced parallel relation to each other, a driven element secured between said upper surface of said movable blade member and said shoe member and including first and second laterally spaced walls, and means detachably securing together in assembled relation said blade member, said driven member, and said shoe member, with said driven member first and second laterally spaced walls extending upwardly through said notch, said first spaced driven element wall located adjacent one of said first and second wall portions and said second spaced driven element wall located adjacent the other of said first and second wall portions, said spaced driven element walls being engaged by said drive member to cause reciprocating movement of said movable blade assembly relative to said first blade.

2. A hair clipper as set forth in claim 1 wherein said driven member includes a yoke member formed of electrically insulating material and including a web connecting said first and second driven element walls, said yoke member also including first and second flange portions respectively extending laterally outwardly from said first and second walls said yoke member supported by said blade member upper surface and said first and second walls extending upwardly therefrom, and with said flange portions in overlying engagement with said upper surface of said blade member.

3. A hair clipper as set forth in claim 2 wherein said shoe member also includes first and second flange portions respectively extending laterally outwardly from said first and second wall portions, and is located with said first and second shoe member wall portions in laterally outwardly overlying engagement with said first and second walls of said yoke member, and with said flange portions of said shoe member in overlying engagement with said flange portions of said yoke member.

4. A hair clipper as set forth in claim 3 wherein said walls of said yoke member include upwardly and rearwardly extending edge portions flaring laterally outwardly.

5. A hair clipper as set forth in claim 3 wherein said movable blade member, said shoe member and said yoke member are separable and wherein said securing means includes at least one bore in one of said blade member and said shoe member and a pin extending from the other of said blade member and said shoe member and engaged in said bore.

6. A hair clipper as set forth in claim 5 wherein at least one of said first and second flange portions of said yoke member includes an aperture therethrough and wherein said pin extends through said aperture.

7. A hair clipper as set forth in claim 1 wherein said blade member has a thin planar construction.

8. A hair clipper as set forth in claim 1 wherein said lower blade includes a forward edge with a series of teeth extending therealong and an upper surface extending from the forward edge, wherein said movable blade member includes a lower planar surface supported by said upper surface of said lower blade, and further including means for supporting said movable blade against said lower blade for linear movement parallel to said forward edge, said supporting means including a spring member having an elongated forward end positionable in said groove and a rearward end having at least one aperture, and means for releasably securing said spring means to said lower blade and including a fixed stud extending from the upper surface of said lower blade through said aperture, and means for securing said spring member to said fixed stud.

9. A hair clipper as set forth in claim 8 and further including a bracket secured to said upper surface of said lower blade, said bracket including a threaded bore therethrough, a screw engaged in said threaded bore to secure said bracket to said lower plate and having an end extending from said bracket and forming said fixed stud.

10. A hair clipper as set forth in claim 9 wherein said means for securing said spring member to said fixed stud includes a nut threadably positioned on said fixed stud, to clamp said spring member between said bracket and said nut.

11. A hair clipper as set forth in claim 1 wherein said fixed blade includes means thereon defining a socket, and further including a blade set mounting assembly including a mounting plate fixed to said housing, a tongue including a shoulder, said tongue being carried by said mounting plate for pivotal movement of said tongue relative to said mounting plate between a first position extending at a substantial angle to said mounting plate and permitting insertion and withdrawal of said tongue relative to said socket, and a second position generally parallel to said mounting plate and preventing such insertion and withdrawal, and a spring secured to said mounting plate and including a first portion having means for engaging said tongue for selectively and releasably holding said tongue in said first position and a second portion for selectively gripping said means defining said socket to releaseably clamp said blade set against said shoulder on said tongue when said stationary blade is assembled on said tongue and in response to movement of said tongue to said second position.

12. A hair clipper as set forth in claim 11 wherein said spring includes opposite ends, said first portion being at one of said opposite ends and said second portion being at the other of said opposite ends.

13. A hair clipper as set forth in claim 12 wherein said means on said lower blade defining said socket includes a mounting bracket having a forward edge, and wherein said second portion includes a spring lip releasably engaging said bracket forward edge when said lower blade is assembled on said tongue and in response to movement of said tongue to said second portion, and wherein said tongue includes a forward end removably extending into said socket and a rearward end connected to said mounting plate, said tongue rearward end including a transverse portion extending transversely to said forward end, said first portion of said spring engaging said transverse portion.

14. A movable blade assembly for a hair clipper blade set, said movable blade assembly comprising a blade member having a forward edge with a series of teeth extending therealong and an upper surface extending from said forward edge, a yoke member including first and second walls extending in laterally spaced relation to each other, said yoke member also including first and second flange portions respectively extending in laterally co-planar relation from said first and second walls, a shoe member including a planar body having an upper surface, a groove formed in said planar body upper surface a notch in said planar body, and first and second wall portions on opposite sides of said notch and extending upwardly from said planar body upper surface and in laterally spaced parallel relation to each other, means detachably securing together in assembled relation said blade member, said yoke member and said shoe member with said first and second yoke member flange portions secured between said shoe member planar body and said blade member upper surface, and with said first and second yoke member walls extending through said notch with said first and second shoe member wall portions in outwardly overlying engagement with said first and second yoke member walls.

15. A movable blade assembly as set forth in claim 14 wherein said walls of said yoke member include upwardly and rearwardly extending edge portions flaring laterally outwardly.

16. A movable blade assembly as set forth in claim 14 wherein said yoke member is fabricated of plastic material which is electrically insulating and wherein said shoe member is metallic.

17. A movable blade assembly as set forth in claim 14 wherein said securing means includes at least one bore in one of said blade member and said shoe member and a pin extending from the other of said blade member and said shoe member and engaged in said bore.

18. A movable blade assembly as set forth in claim 17 wherein at least one of said first and second flange portions includes an aperture therethrough, and wherein said pin extends through said aperture.

19. A movable blade assembly as set forth in claim 14 wherein said blade member has a thin planar construction.

20. A hair clipper blade set including a lower blade including a forward edge with a series of teeth extending therealong and an upper surface extending from the forward edge, a movable upper blade having a forward edge with a series of teeth extending therealong, an upper surface, and a lower planar surface supported by said upper surface of said lower blade, means for supporting said upper blade against said lower blade and for linear movement parallel to said forward edges, said supporting means including a spring member having a forward end positionable against said upper surface of said movable blade and a rearward end having therein at least one aperture, a bracket secured to said upper surface of said lower blade, said bracket including therethrough a threaded bore, a screw threaded into said bracket so as to mount said bracket on said lower blade and having an end extending outwardly from said bracket, and means for releasably securing said spring member to said lower blade without affecting the mounting of said bracket on said lower blade and including said screw end which projects through said aperture in said spring member and a nut threadably positioned on said screw end to clamp said spring member between said bracket and said nut.

21. A hair clipper comprising a housing, a motor located in said housing and including a shaft having a driven member and a blade set connected to said housing and including a lower blade including a forward edge with a series of teeth extending therealong and an upper surface extending from the forward edge, a movable upper blade having a forward edge with a series of teeth extending therealong, an upper surface, and a lower planar surface supported by said upper surface of said lower blade, means for supporting said upper blade against said lower blade and for linear movement parallel to said forward edges, said supporting means including a spring member having a forward end positionable against said upper surface of said movable blade and a rearward end having therein at least one aperture, a bracket secured to said upper surface of said lower blade, said bracket including therethrough a threaded bore, a screw engaged in said threaded bore to mount said bracket on said lower blade and having an end extending from said bracket and through said aperture, and means on said screw end outwardly of said spring member for releasably securing said spring member between said bracket and said securing means without affecting the mounting of said bracket on said lower blade, said lower blade and said bracket defining a socket therebetween, and a blade set mounting assembly including a mounting plate fixed to said housing, a tongue removably extending into said socket, means on said tongue and on said mounting plate affording pivotable movement of said tongue relative to said mounting plate between a first position permitting insertion and withdrawal of said tongue relative to said socket and a second position preventing such insertion and withdrawal, and a spring secured to said mounting plate and including a first portion engaging said tongue for selectively and releasably holding said tongue in said first position, and a second portion for selectively gripping said lower blade to selectively and releasably hold said tongue in said second position.

22. A hair clipper as set forth in claim 21 wherein said blade set mounting assembly spring includes opposite ends, said first portion being at one of said opposite ends and said second portion being at the other of said opposite ends.

23. A hair clipper as set forth in claim 22 wherein said mounting bracket includes a forward edge, said mounting bracket and said fixed blade defining said socket therebetween, and wherein said second portion includes a spring lip releasably engaging said forward edge of said raised central portion, and wherein said tongue includes a forward end removably extending into said socket and a rearward end connected to said mounting plate, said tongue rearward end including a transverse portion extending transversely to said forward portion, said second portion of said spring engaging said transverse portion.

* * * * *